US010376803B2

(12) United States Patent
Honeck et al.

(10) Patent No.: US 10,376,803 B2
(45) **Date of Patent: *Aug. 13, 2019**

(54) SWORD DEVICE WITH RETRACTABLE, INTERNALLY ILLUMINATED BLADE

(71) Applicant: DISNEY ENTERPRISES, INC., Burbank, CA (US)

(72) Inventors: Michael R. Honeck, Glendale, CA (US); Lanny S. Smoot, Thousand Oaks, CA (US); Quinn Y. Smithwick, Pasadena, CA (US); Eli Joseph Romaire, Los Angeles, CA (US); David J. McCall, Woodland Hills, CA (US); Terry O. Sandin, La Crescenta, CA (US); Adam B. Forster, North Hollywood, CA (US); Peter Anastasios Chevako, Los Angeles, CA (US)

(73) Assignee: DISNEY ENTERPRISES, INC., Burbank, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/043,490

(22) Filed: Jul. 24, 2018

(65) Prior Publication Data

US 2018/0326317 A1 Nov. 15, 2018

Related U.S. Application Data

(63) Continuation of application No. 15/460,467, filed on Mar. 16, 2017, now Pat. No. 10,065,127.

(51) Int. Cl.
*A63H 33/30* (2006.01)
*A63H 33/00* (2006.01)
(Continued)

(52) U.S. Cl.
CPC ..... *A63H 33/009* (2013.01); *A63H 33/22* (2013.01); *A63H 33/26* (2013.01); *A63J 5/00* (2013.01); *A63J 7/00* (2013.01)

(58) Field of Classification Search
CPC ..... A63H 33/009
See application file for complete search history.

(56) References Cited

U.S. PATENT DOCUMENTS 3,037,320 A * 6/1962 Powell ..... A63H 33/009 446/473
4,231,077 A * 10/1980 Joyce ..... A63H 33/22 362/109

(Continued)

*Primary Examiner* — Eugene L Kim
*Assistant Examiner* — Matthew B Stanczak
(74) *Attorney, Agent, or Firm* — Marsh Fischmann & Breyfogle LLP; Kent A. Lembke

(57) ABSTRACT

A special effects device for providing an energy sword effect. The device includes two long plastic semi-cylinders, and these two blade body members are rolled perpendicular to their length, which creates compact cylinders of material of small volume that can be provided on a pair of spools in a hilt. To extend the blade, a motor provided in the hilt unrolls the blade body members from the spools. Each blade body member passes through a blade forming guideway that nests the semi-cylindrical blade body members together as they leave the hilt. To retract the blade, the process is reversed. The lighting of the blade is achieved with a flexible strip of light sources. The light source strip is attached to a blade end cap and positioned in the center of the two blade body members such that it is pulled up along with the blade body members during their extension.

25 Claims, 8 Drawing Sheets

(51) Int. Cl.

| | |
|---|---|
| ***A63H 33/26*** | (2006.01) |
| ***A63H 33/22*** | (2006.01) |
| ***A63J 5/00*** | (2006.01) |
| ***A63J 7/00*** | (2006.01) |

(56) References Cited

U.S. PATENT DOCUMENTS 4,678,450 A * 7/1987 Scolari ..... A63H 33/009 315/241 P
4,891,032 A * 1/1990 Davis ..... A63H 33/00 446/484
4,904,222 A * 2/1990 Gastgeb ..... A63H 5/00 310/331
5,145,446 A * 9/1992 Kuo ..... A63H 5/04 446/405
5,279,513 A * 1/1994 Connelly ..... A63H 33/009 446/219
5,321,591 A * 6/1994 Cimock ..... H05B 39/09 315/200 A
5,324,227 A * 6/1994 Yuh-Ching ..... A63H 33/009 446/473
5,919,079 A * 7/1999 Coleman ..... A23G 3/50 426/134
5,947,789 A * 9/1999 Chan ..... A63H 33/009 362/277
6,030,272 A * 2/2000 Hu ..... A63H 33/009 446/233
6,036,576 A * 3/2000 Colon, Jr. ..... A63H 33/009 446/170
6,082,876 A * 7/2000 Hanson ..... A63H 33/22 362/293
6,150,947 A * 11/2000 Shima ..... A63H 5/00 340/692
6,244,723 B1 * 6/2001 Talamo ..... G09F 13/00 362/157
D603,464 S * 11/2009 Roos ..... D21/567
7,611,398 B2 * 11/2009 Woodhouse ..... A63H 33/009 446/473
7,766,721 B2 * 8/2010 Ma ..... A63H 33/009 446/473
8,089,458 B2 * 1/2012 Barney ..... A63F 13/428 345/158
8,790,180 B2 * 7/2014 Barney ..... A63F 13/08 463/39
8,961,312 B2 * 2/2015 Barney ..... A63F 13/10 345/158
9,579,587 B1 * 2/2017 Chen ..... A63H 33/009
9,630,120 B2 * 4/2017 Stubenfoll ..... A63H 33/009
9,675,878 B2 * 6/2017 Barney ..... A63F 13/428
9,707,478 B2 * 7/2017 Barney ..... A63F 13/428
9,737,797 B2 * 8/2017 Barney ..... A63F 13/428
10,065,127 B1 * 9/2018 Honeck ..... A63J 7/00
2001/0024973 A1 * 9/2001 Meredith ..... A63F 13/06 463/36
2007/0218803 A1 * 9/2007 Tong ..... A63H 33/009 446/473
2007/0254553 A1 * 11/2007 Wan ..... A63H 33/22 446/175
2007/0270077 A1 * 11/2007 Woodhouse ..... A63H 33/009 446/473
2008/0051003 A1 * 2/2008 Hom ..... A63H 33/009 446/473
2010/0048097 A1 * 2/2010 Ma ..... A63H 33/009 446/473
2014/0106644 A1 * 4/2014 Urbaniak ..... A63J 21/00 446/473
2015/0314213 A1 * 11/2015 Zhou ..... A63J 21/00 446/485
2016/0008730 A1 * 1/2016 Stubenfoll ..... A63H 33/009 446/170
2017/0306180 A1 * 10/2017 Albright ..... C09D 179/02
2019/0022542 A1 * 1/2019 Graves ..... A63H 33/009

* cited by examiner

SWORD DEVICE WITH RETRACTABLE, INTERNALLY ILLUMINATED BLADE

CROSS REFERENCE TO RELATED APPLICATIONS

This application is a continuation of U.S. patent application Ser. No. 15/460,467, filed Mar. 16, 2017, which is incorporated herein by reference in its entirety.

BACKGROUND

1. Field of the Description

The present description relates, in general, to theatrical props and toys simulating fictional energy swords or lightsabers and, more particularly, to a special effects device for use as a toy, theatrical prop, or collector's item that accurately simulates fictional operations of an energy sword or "lightsaber" found in many popular films.

2. Relevant Background

There are many fictional characters whose weapon of choice is an energy sword, and many films have been produced depicting these characters doing battle with their fantastical energy swords. In some stories, these energy swords are called lightsabers, and a typical lightsaber in a film is depicted as including a metal hilt that allows the lightsaber to be a handheld weapon. The hilt is activated by the character in the film to project a brightly lit energy blade that is two to four or more feet long (e.g., an average of 3 feet in length but that is generally proportionate to the operator) and that in the films can cut, burn, and melt through most substances with little resistance. In the films, an active lightsaber makes a distinctive humming, which rises in pitch and volume as the blade of the lightsaber is moved rapidly through the air, and contact between another lightsaber's blade produces a loud crackling noise.

To provide energy swords in films, many post-production techniques such as computer-generated imagery (CGI) exist that can be used to realistically extend and retract a long energy blade from a hilt, which can be a physical prop in a character's hand. Producing a toy, a collector's item, or a theatrical prop for live theater or shows that effectively simulates an energy sword such as a lightsaber has proven much more challenging.

There are many commercially-available lightsaber products, but most have only been effective at simulating a portion of the unique features of the fictional energy swords seen in films. For example, many lightsaber products focus on combat durability but fall far short on providing realistic appearance. Others provide very realistic appearing and brightly lit blades along with effective sound effects. However, very few lightsaber products have even attempted to recreate the extending and retracting capabilities of the lightsaber blade shown in films, and these products have typically failed in other aspects such as failing to produce a brightly lit blade or producing a less realistic blade than other products without a retractable blade. None of these lightsaber products have been able to achieve extending and retracting of the energy blade with bright hilt lighting combined with a lack of a visible support structure for the blade.

SUMMARY

Briefly, the inventors recognized that there was a need for a new special effects device that can be used as a theatrical prop, toy, or collector's item that effectively simulates fictional energy swords including the lightsabers found in many popular films. Particularly, the special effects device (or energy sword, lightsaber prop, or the like) is specially configured to provide an extendable and retractable energy blade that appears to emanate from a handheld hilt due to a lighting effect that appears to provide bright hilt-based lighting.

In some useful embodiments, the special effects device includes two long plastic cylinders that are cut lengthwise. These two pieces (or blade body members) are then each rolled perpendicular to their length (or their central axis), which creates compact cylinders of material of relatively small volume that can be provided on a pair of spools or reels. The spools holding the blade body members, along with other blade-producing elements, are housed within the body of the hilt assembly of the special effects device or lightsaber prop.

To extend the blade, a motor provided in the hilt body is operated to unroll the rolled/spooled plastic blade body members from their reels/spools with each member (or blade half) acting much like a metal carpenter's tape measure. Each blade body member passes through a blade forming guideway or passageway that acts to "zip" the two semi-cylindrical blade body members together (or with portions along their length overlapping each other or one nesting inside the other) as they leave the hilt body, thereby forming the energy blade. To retract the blade, the process is reversed with the motor acting to wind the pair of spools to reel or wind the extended blade body members back into the hilt body and onto the pair of spools/reels.

The special effects device or lightsaber prop is designed to illuminate the two blade body members internally or from within the interior space of the blade to provide the illusion of a hilt-illuminated energy blade. In some embodiments, lighting of the blade is achieved by including a flexible strip of light sources (such as a flexible strip of light emitting diodes (LEDs)). The flexible strip of light sources is attached in the center of the two semi-cylindrical blade body members (such as to an end cap attached to exposed or outer ends of the two blade body members) such that it is pulled up (or unspooled) along with the blade body members during their extension or deployment. During retraction of the blade body members, the flexible strip of light sources is also pulled back into the hilt body such as through the use of a one-way bearing.

In some particular embodiments, the blade includes an anisotropic (or 1D) diffuser whose diffusion direction is along the length of the extended or deployed blade (i.e., parallel to the central axes of the two blade body members). The anisotropic diffuser blends the points of light from the individual light sources (e.g., LEDs) into a single continuous and evenly illuminated line. The anisotropic diffuser may be spaced a distance away from the LEDs to provide the appearance of a penumbra or glow around the central axis of the extended blade or central axis of the flexible strip of light sources (e.g., central blade of blended LEDs). In some cases, the anisotropic diffuser or diffusion function is provided by forming the two blade body members out of flexible diffusion material that is formed into half cylinders.

More particularly, an apparatus (e.g., a lightsaber prop or the like) is provided for producing an energy sword special effect. The apparatus includes a hilt assembly including a drive assembly within a hilt body. The apparatus also includes a blade including a flexible strip with a plurality of light sources arranged in a linear pattern and an anisotropic diffuser diffusing light output from the plurality of light sources. During operations, the drive assembly operates in a first operating state to extend the blade outward from an opening in the hilt body and in a second operating state to retract the blade into the hilt body through the opening in the hilt body.

In some embodiments, the blade includes an end cap and a pair of blade body members each attached at a first end to the end cap. The blade body members each has a semicircular cross section (in a plane orthogonal to a longitudinal axis of the blade body member) when in the extended position/state. In the same or other embodiments, the pair of blade body members are at least partially nested together (e.g., with an edge of one member overlapping the adjacent edge of the other member) to define a hollow cylindrical body of the blade. To provide internal illumination of the blade, the flexible strip with the plurality of light sources is attached at an end to the end cap and is positioned within the hollow cylindrical body of the blade. In one useful implementation of the apparatus, the light sources each is a light emitting diode (LED) such as a white or colored LED with the flexible strip including a flexible circuit board in some cases and/or such as by tinting of the diffusion material to produce the blade color (as used in one prototype with white LEDs).

In some cases, the anisotropic diffuser is a separate component while in other cases it is provided by the pair of blade body members with each of the blade body members formed from a strip of diffusion material (e.g., a rectangular strip with a width of 0.5 to 2 inches and a length of 2 to 6 feet or the like). To facilitate retraction, each of the blade body members has a planar cross section in a plane orthogonal to a longitudinal axis of the blade body member when the blade body member is retracted into the hilt body. To form the blade and support retraction, the hilt assembly also includes a blade form shaping the blade body members into the planar cross section during retraction of the blade into the hilt body and into the semicircular cross section during extension of the blade from the hilt body.

In some embodiments, the hilt assembly includes a first spool, pivotally supported in the hilt body, for receiving a first one of the blade body members during retraction of the blade into the hilt body and a second spool, pivotally supported in the hilt body, for receiving a second one of the blade body members during retraction of the blade into the hilt body, and the drive assembly may include a drive motor operating to concurrently rotate the first and second spools in a first direction during retraction of the blade into the hilt body and in a second direction, opposite the first direction, during extension of the blade out of the hilt body. The hilt assembly further may include a third spool, pivotally supported in the hilt body, for receiving the flexible strip with the light sources during retraction of the blade into the hilt body. The blade has a uniform outer diameter along its length when extended out from the hilt body, and the blade width may be in the range of 0.5 to 2 inches. Also, the drive assembly is configured such that the blade is moved between a fully retracted state and a fully extended state in less than 1 second, with a blade having a length of at least 24 inches (such as 30 to 36 inches or more).

DETAILED DESCRIPTION OF THE PREFERRED EMBODIMENTS

Briefly, a special effects device is provided that is useful for simulating an extending and retracting, internally lit, and handheld energy sword (e.g., a lightsaber popular in many science fiction movies). The special effects device solves several issues with prior devices as it provides a retractable blade with a single (or continuous) width along its length. When extended, the blade appears to be energized from the hilt or illuminated from a hilt assembly through the use of a flexible strip of point light sources positioned between two blade body members. The blade body members along with the strip of light sources can be reeled back into the body of the hilt assembly to imitate activation and deactivation of an energy sword such as a lightsaber found in many movies. Further, the lighting effect is furthered by forming the blade body members of flexible diffusion material to provide an anisotropic (or 1D) diffuser whose diffusion is along the length of the blade (or along the central axes of the extended blade body members and strip of light sources) to blend the light into a contiguous and evenly illuminated beam of light. In operation, the special effects device provides a more aesthetically correct (relative to movie depictions) energy sword than prior lightsaber products and designs.

Figure 1:
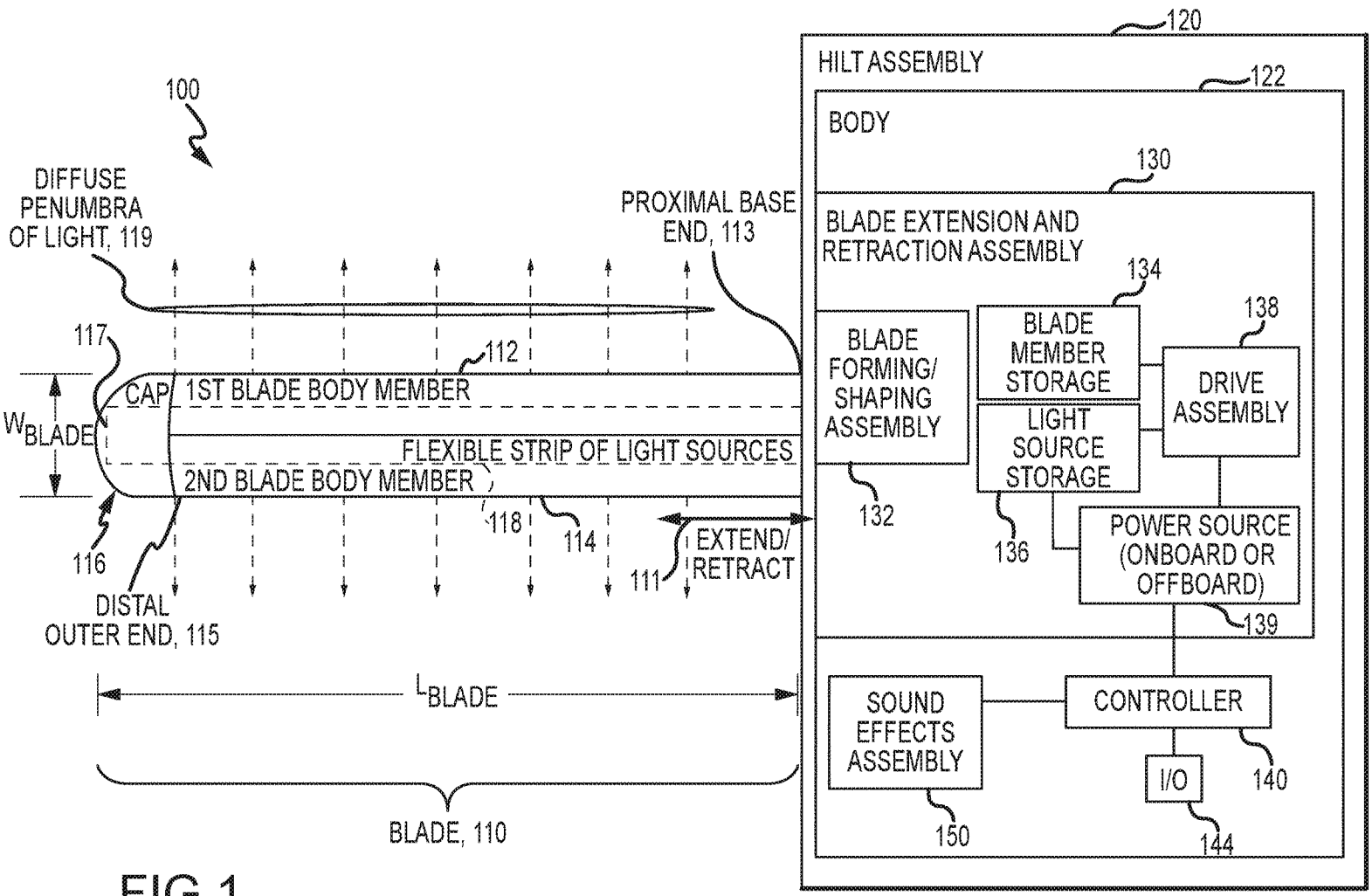
FIG. 1 is a functional block diagram of a special effects device (or an energy sword device or a lightsaber prop/toy or the like)

FIG. 1 illustrates a functional block diagram of a device 100 that is useful for implementing an energy sword such as a lightsaber for use as a theatrical prop or a toy. The device 100 includes an elongated blade 110, with an extended length, $L_{Blade}$, which can be in the range of 2.5 to 6 feet (with 3 feet being common in some prototypes) as measured from a proximal or base end 113 to an outer surface of an end cap 116 near the distal outer end 115 of the blade 110. Generally, the blade 110 is cylindrical in shape when deployed or extended as shown in FIG. 1. The blade 110 is configured for retraction (i.e., is retractable as shown in FIGS. 2-5) and also for extension or deployment as is shown in FIG. 1 with double arrows 111 (from the shown extended or deployed length, $L_{Blade}$ to being fully retracted or no length). The blade 110 has a single or uniform width, $W_{Blade}$, along its length (or at least along the length of the blade body members 112, 114), which can be in the range of 0.5 to 3 inches (or a cylinder having an outer diameter (OD) of 0.5 to 3 inches), which is in contrast to prior telescoping devices with a tapering OD from their bases to their tips.

The blade 110 is formed of a pair of elongated blade body members 112, 114 that are formed of a flexible yet relatively stiff material. Each blade body member 112, 114, when extended, is shaped to have a semi-circular cross section or to provide half or more of a cylinder, and portions of the two body members 112, 114 meet or overlap along the length, $L_{Blade}$, of the blade 110. In this way, the two blade body members 112, 114, when extended 111 as shown in FIG. 1, form a blade 110 that is hollow and cylindrical. This cylindrical shape is maintained or held, in part, by attaching each of the blade body members 112, 114 at the distal or outer end 115 to an interior surface or edge of a semispherical-shaped cap 116 (e.g., a clear or translucent plastic cap with an OD matching the width, $W_{Blade}$, of the blade 110). As explained below, the blade body members 112, 114 are reshaped to be planar (except for distal ends 115) when retracted/reeled-in for storage in the hilt assembly 120 and are separated from their overlapping configuration shown in FIG. 1 by being wrapped onto two different spools or reels in the body 122.

The blade 110 is illuminated from within or internally lit when extended 111 to provide a diffuse penumbra of light 119. In some embodiments, light sources are powered on as the blade is extended and powered off as the blade is retracted. Diffusion is aided or achieved in some implementation by forming the blade members 112, 114 of a translucent plastic material, and, in some embodiments, the blade body members 112, 114 are formed of a diffusion material (e.g., a Light Shaping Diffuser available in sheets/rolls on polycarbonate or polyester substrates from Luminit, LLC or another diffusion material available from this or another commercial source) chosen to allow them to behave as an anisotropic (1D) diffuser.

The blade 110 includes a flexible strip of light sources 118 that extends from the proximal or base end 113 of the blade to (or past) the distal or outer end 115 of the blade 110. In one embodiment, the flexible strip of light sources 118 is provided as a strip of colored light emitting diodes (LEDs) (e.g., green, red, or blue LEDs) or as a strip of white LEDs (with the blade being dyed/colored a desired color to get accurate color control) that are concurrently operable along the length of the strip 118 (e.g., all are powered on upon initiation of extension and powered off upon initiation of retraction or after retraction is completed). The LEDs may be ganged into segments, and the segments can be illuminated in sequence right before they exit the hilt so as to not overheat the spool. One end of the strip of light sources 118 is attached to an interior surface of the cap 116 as shown at 117 (e.g., to the center of the cap 116), and the strip 118 has a width less than the blade width, $W_{Blade}$, to allow its free or non-binding movement relative to the blade body members 112, 114. This attachment to the cap 116 causes the flexible strip of light sources 118 to be pulled out of the body 122 of the hilt assembly 120 concurrently with extension or deployment 111 of the two blade body members 112, 114 (which also push the cap 116 outward into space ahead of their ends 115).

The device 100 includes a hilt assembly 120 from which the blade 110 is extended 111 and into which the blade 110 is retracted 111 when not activated. Specifically, the hilt assembly 120 includes a body 122 that may have one or more sidewalls defining an interior space for receiving the blade 110 when it is retracted 111 and for including a blade extension and extraction assembly 130 with components for providing the extending/retracting 111 of the blade 110. The body 122 may be generally cylindrical in shape and sized for being held in a person's hand such as with a length of 6 to 12 inches or the like with an outer diameter in the range of 2 to 4 inches (or with a smaller portion to provide a gripping surface for a user). The body 122 may include an outlet or aperture on one end through which the blade 110 may extend during extension and may be withdrawn during retraction, and this outlet/aperture may be circular in shape with a diameter greater than the blade width, $W_{Blade}$. The body 122 may be formed of a metal, a plastic, or a ceramic and have rigid sidewalls to support the blade extension and retraction assembly 130 and other components of the hilt assembly 120 housed within its interior space.

The blade extension and retraction assembly 130 includes a blade forming/shaping assembly 132 proximate to the outlet/aperture of the body 122. This assembly 132 is configured to, during extension, receive planar sections of the blade body members 112, 114 (e.g., from reels/spools) and to impart a semi-circular cross-sectional shape to the blade body members 112, 114 at or prior to the aperture/outlet of the body 122 and to encourage the nesting of one member 112 (or 114) within the other member 114 (or 112) to provide overlapping portions along each edge/side of the blade body members 112, 114.

The blade extension and retraction assembly 130 also includes a blade member storage 134 and a light source storage 136. These may take the form of a spool or reel for each of the blade body members 112, 114 and the flexible strip of light sources 118, with the members 112, 114 and strip body/substrate (e.g., a flexible circuit board) of flexible strip of light sources 118 being wrapped with a planar or linear cross-sectional shape onto the spools/reels. Each spool or reel may be mounted within the body 122 to be freely rotatable about its center axis (e.g., on a supporting shaft/axle).

The blade extraction and retraction assembly 130 also includes a drive assembly 138 that is selectively operable (via control signals from a controller 140 or to a power source 139 operating the drive assembly 138) to drive the blade body members 112, 114 outward from the body 122 via the blade forming/shaping assembly 132 during extension and to pull or wind the blade body members 112, 114 into the body 122 during retraction. In the example of spools/reels being used for storage devices 134, the drive assembly 138 may include an electric motor that operates to rotate the spools/reels in a first direction to provide extension and in a second direction to provide retraction. Full extension may be provided by a number of rotations of the spool/reel, by a timed amount of operation of the motor, and/or by rotating the spools/reels until the full length, $L_{Blade}$, is achieved (sensed via resistance to further rotation or the like), and the extension and retraction rates may be chosen to be relatively quick in some embodiments to achieve a desired visual effect (e.g., a rate in the range of 6 to 10 feet per second or the like in either direction). An onboard (e.g., a battery in the hilt body 122) or offboard power source 139 may be provided as part of the assembly 130 to power the drive assembly 138 and, in some cases, the light sources on the flexible strip 118.

The hilt assembly 120 further includes a controller 140 operable to respond to a user's operation of input/output (I/O) devices 144 to trigger the extension 111 of the blade 110 or to trigger its retraction 111. Particularly, the I/O devices 144 may include any kind of input, including for example a button, a switch, a trigger device, or the like for manual input or may take the form of a touchscreen or the like, or voice activation or the like, or trigger based on output by an IMU or the like, and the controller 140 may respond to operation of the I/O devices 144 to power the drive assembly 138 (or its electric motor(s)) to rotate the storage spools/reels of blade member storage 134 in a first direction (e.g., clockwise (CW) or counterclockwise (CCW)) and to concurrently power the light sources on the flexible strip 118 during extension and then halt power to the drive assembly 138 upon full extension 111. Upon a second input indicating retraction is desired by an operator, the controller 140 may act to power the drive assembly 138 and operate the motor of the drive assembly 138 to rotate the spools/reels of the blade member storage 134 in a second direction (e.g., CCW or CW) and to cut off power to the light sources on the flexible strip 118.

The hilt assembly 120 further may include a sound effects assembly 150 in the body 122. The sound effect assembly 150 may include a speaker(s) and sound equipment including soundtracks to selectively output a sound (e.g., a humming noise, a cracking noise, and the like) during use of the device 100 such as humming when the blade 110 is extended and changing the hum pitch upon detection of particular movements of the blade 110. Detection of movements could be done by, for example, an inertial measurements unit (IMU) in the assembly 150, which may be placed in or on the body 122. In other embodiments, the sound effects assembly 150 is at least partially provided offboard to provide higher quality sound (e.g., more volume) and to save space in the body 122.

Figure 2:
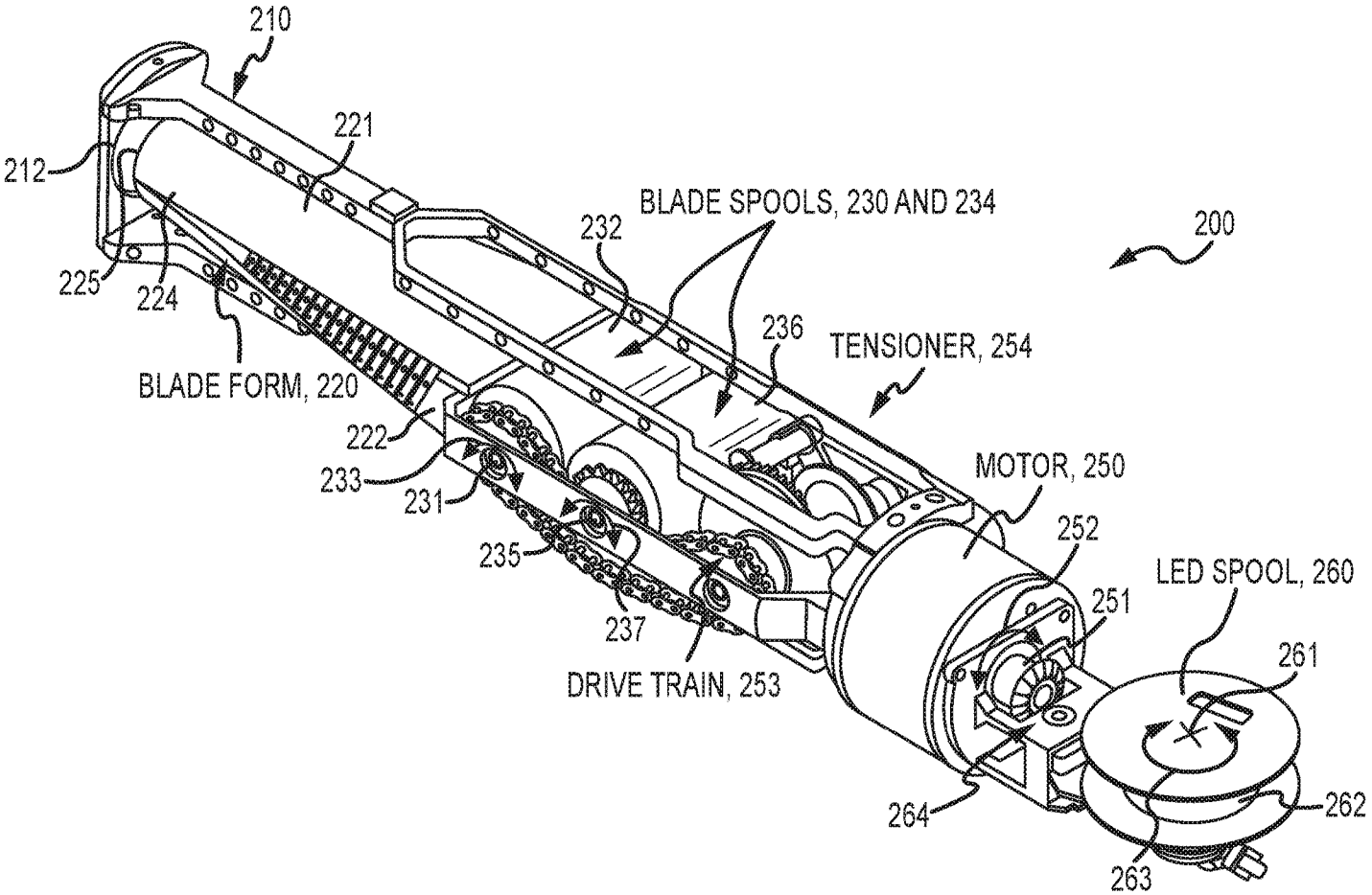
FIG. 2 is a top perspective view of one embodiment of a special effects device, such as may be used to implement the device of FIG. 1, with outer sidewalls of the hilt body removed to show internal components and prior to feeding of the blade body members to an end cap via a blade form and prior to attaching an end of a strip of LEDs to the end cap also through the blade form.
Figure 3:
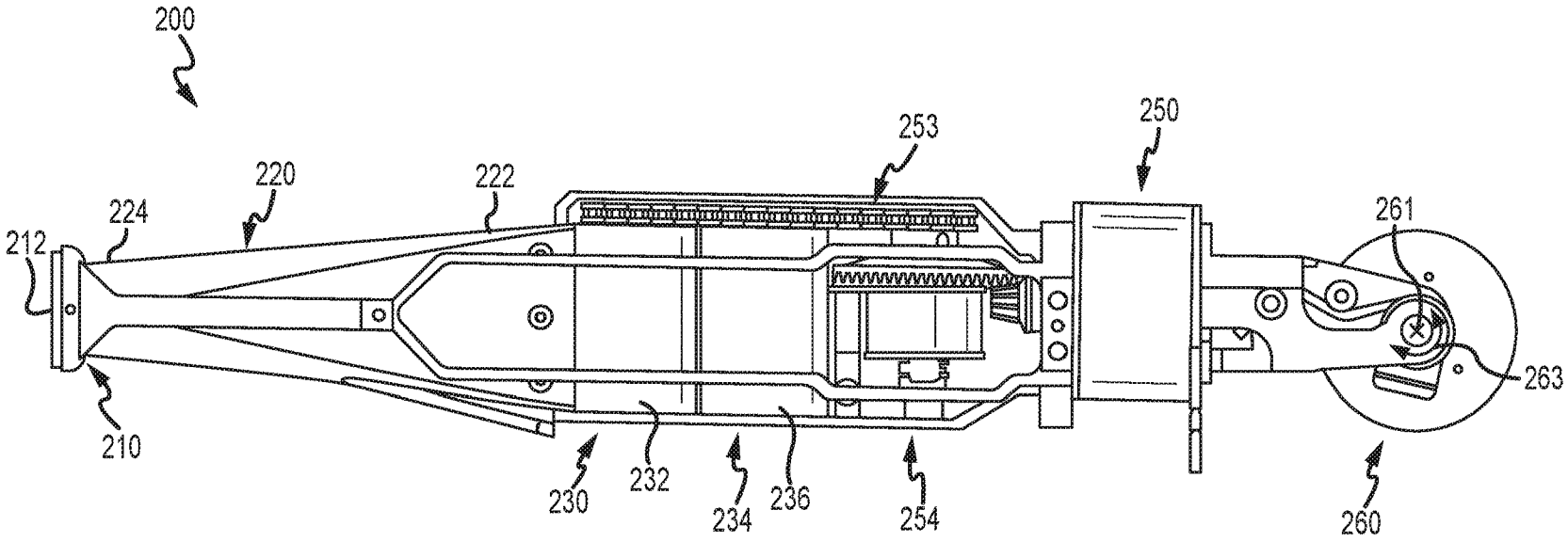
FIG. 3 is a bottom view of the special effects device of FIG. 2.
Figure 4:
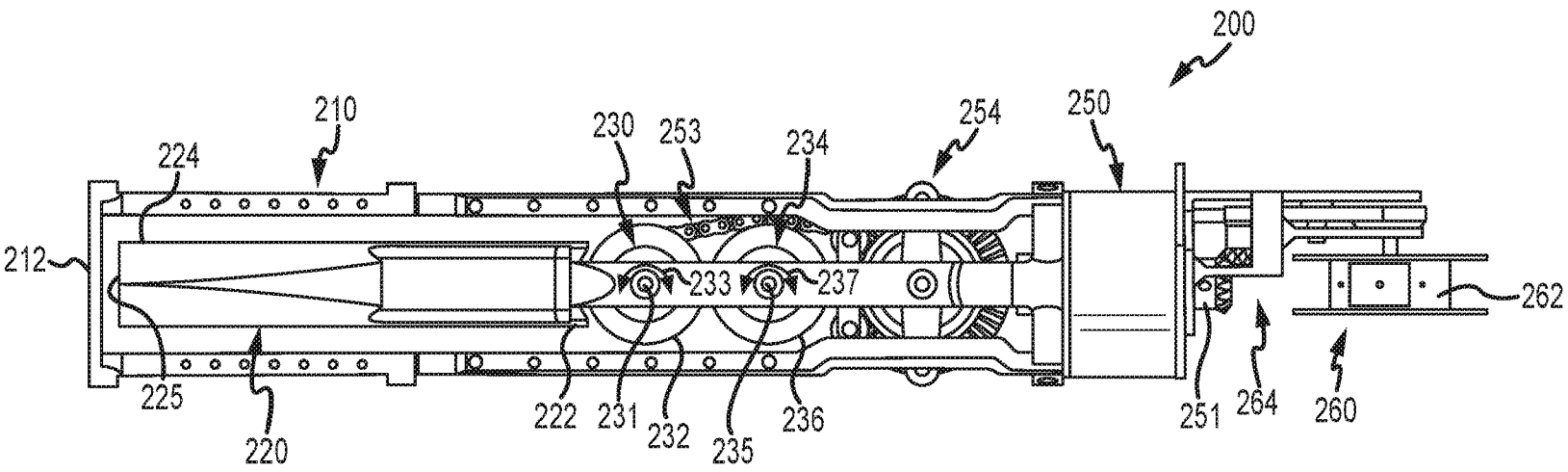
FIG. 4 is a first side view of the special effects device of FIGS. 2 and 3.
Figure 5:
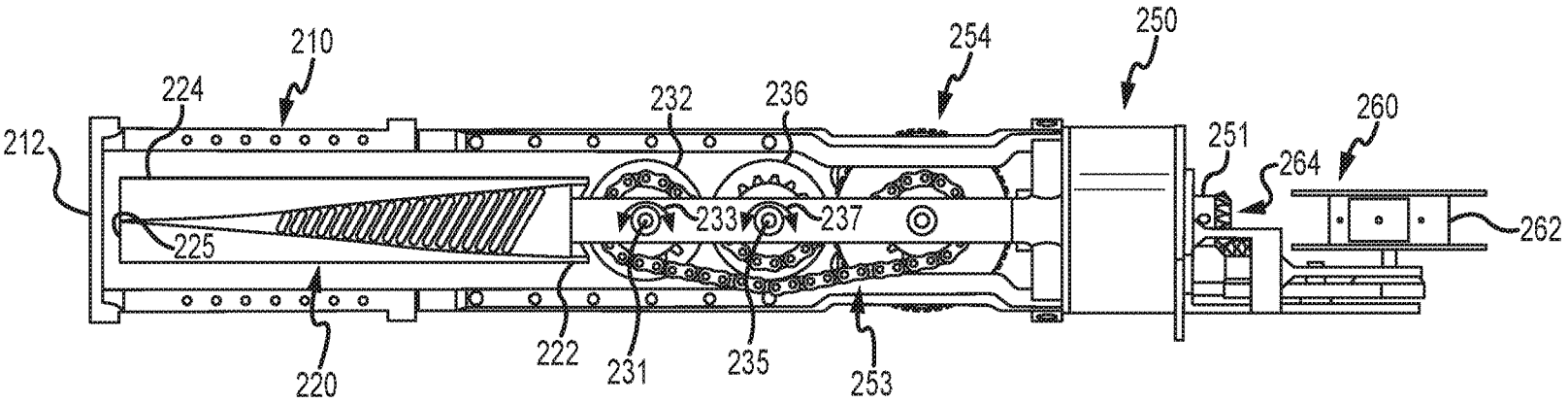
FIG. 5 is a second side view of the special effects device of FIGS. 2-4 that is opposite the view of FIG. 4.

FIG. 2 is a top perspective view of one embodiment of a special effects device 200, such as may be used to implement the device 100 of FIG. 1. The device 200 is shown with outer sidewalls of the hilt body 210 removed to show internal components. Also, the device 200 is shown prior to feeding the blade body members 232 and 236 to an end cap (not shown but understood from FIG. 1 and cap 116) via a blade form 220 and prior to attaching an end of a strip of LEDs 262 to the end cap also through the blade form 220. FIG. 3 is a bottom view of the special effects device 200 of FIG. 2, FIG. 4 is a first side view of the special effects device 200 of FIGS. 2 and 3, and FIG. 5 is a second side view of the special effects device 200 of FIGS. 2-4 that is opposite the view of FIG. 4.

As shown, the special effects device 200 includes a hilt assembly (as discussed with reference to FIG. 1) that includes a hilt body or housing 210, which generally is composed of a frame covered by one or more sidewalls (not shown in FIGS. 2-5 to shown internal components of the hilt assembly and device 200). The frame along with the sidewalls of the hilt body 210 are designed to provide supporting structures and surfaces for the other components of the device 200 and also to take a form factor similar to an energy sword or light saber hilt being simulated or replicated. To this end, the hilt body 210 may be 6 to 12 inches (or more) long and have a diameter of 2 to 4 inches to allow the device 200 to be handheld during its use. At an upper or outer end of the body 210, an opening or outlet 212 is provided with an inner diameter that is at least as large as the outer diameter of the end cap of the blade formed with the device 200 (e.g., 1 to 2 inch (or more) ID) so that the end cap can be received through the opening or outlet 212 when the blade is retracted through operation of the device 200 and to allow the end cap to freely pass outward when the device 200 is operated to extend or deploy the blade.

The special effects device 200 further includes a pair of blade spools (or reels) 230 and 234 pivotally mounted within the interior space of the body 210 on a pair of axles/shafts 231, 235. One spool 230 is used to store or hold a first blade body member 232 (e.g., a length of flexible diffusion material of a desired width (e.g., a width of 1 to 4 inches) to suit the OD of the blade formed with this body member 232). The other spool 234 is used to store or hold a second blade body member 236 (again, a length of flexible diffusion material of a width useful for forming the blade with the other body member 232). The axles/shafts 231, 235 are arranged to be orthogonal to the longitudinal axis of the body 210 such that the blade body members 232, 236 can unspooled and reeled-in directly from the opening 212 of the body 210 without twisting.

The material of the body members 232, 236 is flattened to facilitate wrapping onto the spools 230, 234 and then is later during deployment or blade extension shaped to have a semi-circular cross section by the blade form 220. Particularly, the blade form (or blade forming/shaping assembly) 220 is arranged in the interior space of the hilt body 210 with a first end 222 adjacent the pair of spools 230, 234, and this end 222 has a pair of relatively wide and planar openings or slots for receiving the material of the blade body members 232, 236 as it is fed off the spools/reels 230, 234 into the blade form 220 during blade extension (or for dispensing the material of the blade body members 232, 236 as it is returned back onto the spools/reels 230, 234 during retraction).

The blade form 220 further includes a second end 224 adjacent the hilt body opening/outlet 212. This end 224 includes a circular outlet/aperture 225 that has an ID of about the OD of the blade end cap, and, when the blade is retracted, the end cap would be positioned proximate to (or some distance within) the outlet/aperture 225. The outer ends of the blade body members 232, 236 are attached to the end cap (such as to its inner surfaces or about its sidewall) so as to each be semi-circular shaped at their ends. Further, the blade form 220 includes guide surfaces that urge, during extension, the planar blade body members 232, 236 to take on a semi-circular cross sectional shape as they travel between the first and second ends 222, 224 of the blade form 220. Further, one of the body members 232 or 236 is caused to partially overlap the edges of the other body member 236 or 232 and/or to cause the two body members 232, 234 to become at least partially nested as they are pushed out of the outlet/aperture 225 of the blade form 220 (and follow the end cap with its circular end to which they are attached).

The special effects device 200 includes an electric motor 250 in the body 210 that is operated (e.g., by a controller not shown but understood from controller 140 of FIG. 1) to rotate a shaft 251 in a first direction during extension of the blade (or blade body members 232, 236) and in a second direction during retraction of the blade (or blade body members 232, 236). A drive train 253 is provided between the motor 250 and the blade spools 230, 234 that is driven by rotation of the motor shaft 251 to rotate as shown with arrows 233 and 237 the spool axles/shafts 231, 235, respectively, to rotate the spools 230, 234 in a concurrent manner and also in the same direction (i.e., either CW or CCW). The drive train 353 is shown to include a pair of drive gears combined with a chain drive, but other configurations may be used to implement the device 200. Further, in the illustrated embodiment, a tensioner 354 is included to retain a desired amount of slack in the two blade body members 232, 236 during operations of the special effects device 200 as the circumferences of the spooled material changes over time. The motor 250 is selected to provide relatively rapid extension and retraction with the rotations 233, 237 such as to fully extend or retract the blade in less than 1 second (with a 3 to 6 foot blade). An offboard power source may be used for the motor 250 or an onboard source (e.g., a battery) may be added to the device 200 and positioned within the body 210.

The special effects device 200 further includes an LED spool 260 that is mounted within the interior space of the hilt body 210 for rotation about a central axis 261 as shown with arrows 263. Particularly, a spool drive 264 that is also coupled (e.g., via gear sets) to the drive shaft 251 of the electric motor 250, and the spool drive 264 is configured to rotate 263 the spool 260 to wind or unwind a flexible strip of light sources (e.g., LEDs) 262 at the same rate and in the same direction (into or out of the body 210) as the spools 230, 234. Although not shown in FIGS. 2-5, the exposed or outer end of the light strip 262 would be attached to the interior of the blade end cap and a length of the strip 262 would be fed through the body 210 to and through the blade form 210 so as to extend between the blade body members 232, 236 in the blade form 210 and be fed out of and back into the body 210 via apertures 225, 212 with the end cap and body members 232, 236 in the center of the formed (and retracted) blade. The width of the flexible light strip 262 typically is significantly less than the width of the blade body members 232, 236 and less than a width (or OD) of the formed blade (such as 0.25 to 0.5 inches in width when the blade OD is 1 to 2 inches).

Figure 6:
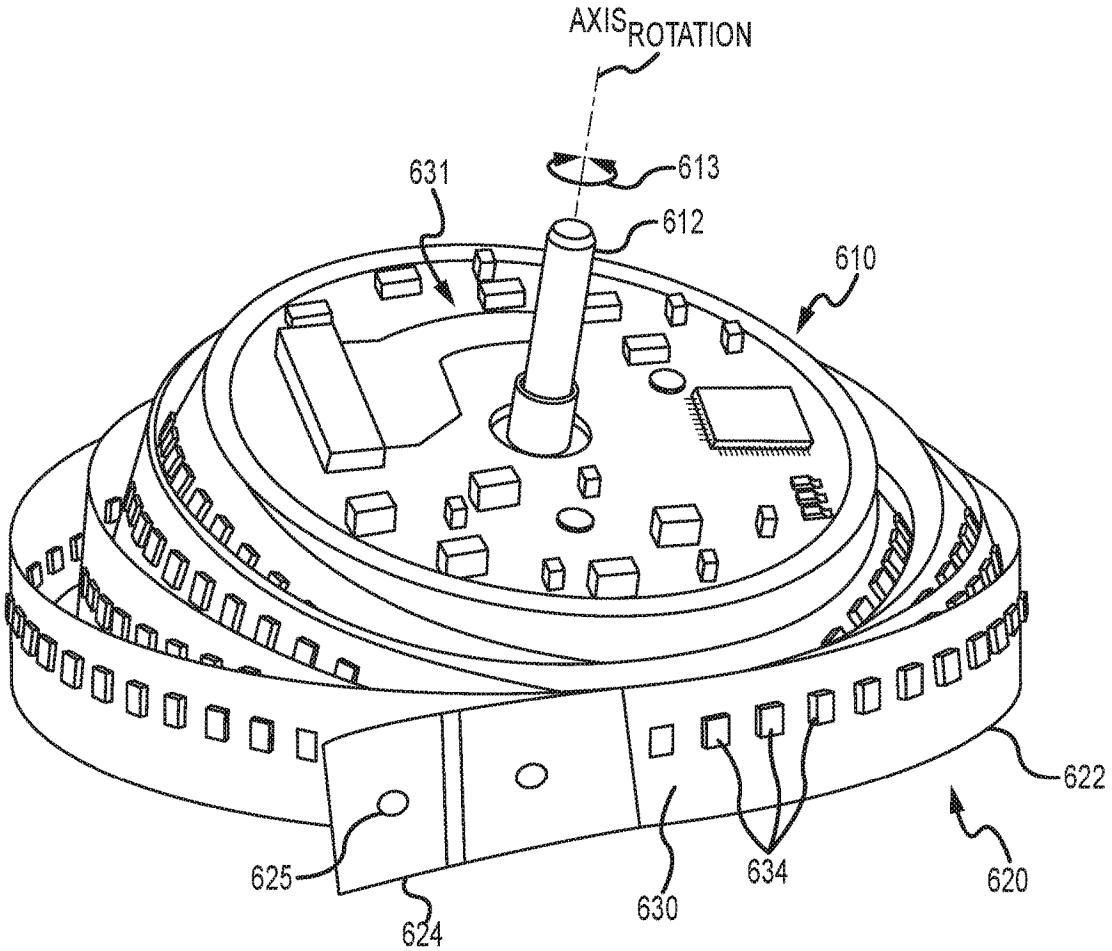
FIG. 6 illustrates a light source spool for storing/holding and feeding out a flexible strip of light sources from a hilt assembly.

FIG. 6 illustrates one useful example of a light source spool 610 for use in a hilt assembly of the present description such as for light source storage 136 in FIG. 1 or LED spool 260 in FIGS. 2-5. As shown, the spool 610 includes a central support shaft/axle 612 that would be pivotally supported within a hilt body and rotated, e.g., by rotation of a drive motor shaft, as shown with arrows 613 to rotate the spool 610 in CW and CCW directions (one used for unwinding during blade extension and one used for reeling in the light source strip during retraction) about the spool's axis of rotation, $Axis_{Rotation}$.

A flexible light source strip 620 is shown to be loosely wound onto the spool 610. In this embodiment, the strip 620 includes a length (e.g., 4 to 7 feet or the like) of substrate or tape 624 upon which a flexible circuit board 630 is mounted or applied. Further, the strip 620 includes numerous LEDs 634 (e.g., hundreds of LEDs of a particular color) that are selectively powered on and off via the circuit board 630 and control/power circuitry 631 mounted onto one face of the spool 610 in this exemplary embodiment. The LEDs 634 may be powered on as a group upon initiation of extension (and turned off as a group upon retraction) or sequentially in an individual manner with those near the end 624 being turned on first during extension (and last upon retraction) or in groups (such as groups of 10 to 20 being fired on or off together) to achieve a desired illumination effect for the interior of a blade. When installed, the exposed/outer end 624 of the light strip 620 is attached, such as via mounting hole 625, to an inner surface (generally, centrally) of a blade end cap such that the flexible light strip 620 extends outward with the cap and is retracted inward with the cap (or, more accurately, the cap is pushed outward and pulled back inward with rotation 613 of the spool 610 about axis, $Axis_{Rotation}$, during driving by a drive motor such as motor 250 of FIGS. 2-5).

Figure 7:
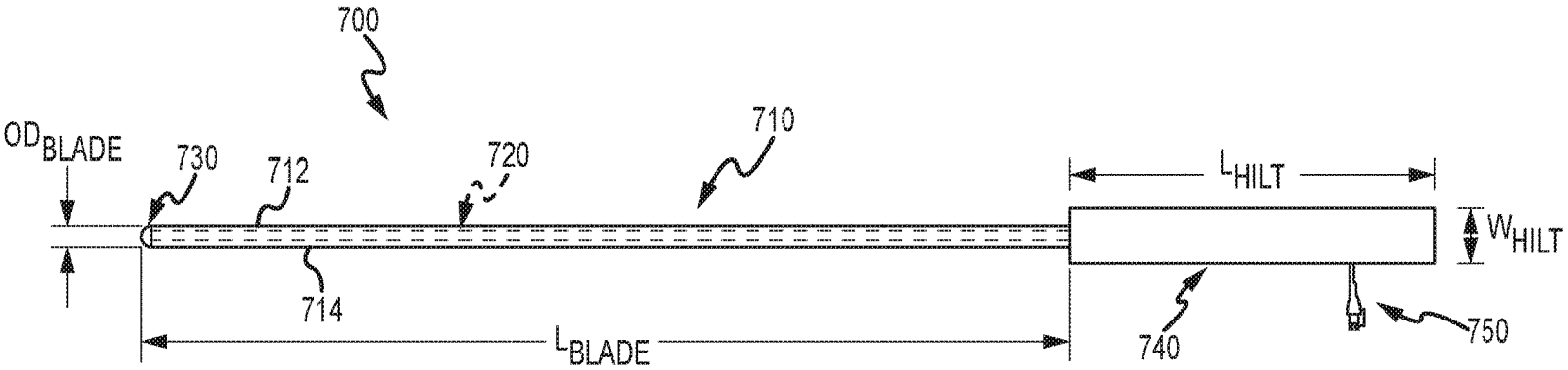
FIG. 7 is a side view of a special effects device of the present description, such as an implementation of the devices of FIGS. 1-5, that has been activated or operated to have an extended blade.

FIG. 7 is a side view of a special effects device 700 of the present description, such as an implementation of the devices of FIGS. 1-5, that has been activated or operated to have an extended blade 710. As shown, the device 700 includes a blade 710 extending outward from a hilt body/housing 740 (e.g., a body similar to body 210 of FIG. 2 with sidewalls installed) or, more specifically, from an outlet/opening in an end of the body 740 that is proximate to a blade shaping/forming assembly or blade form. The device 700 is configured for external power (and/or control) with power connector 750 shown in FIG. 7 extending from the hilt body/housing 740.

The device 700 is a handheld device, and the hilt body 740 may have a length, $L_{Hilt}$, and width (or OD), $W_{Hilt}$, to suit such a purpose such as in the ranges, respectively, of 10 to 14 inches (with 12 inches used in one prototype) and 1.5 to 2 inches (with 1.75 inches used in one prototype). The blade 710 is formed by extending outward from the hilt body 740 a pair of blade body members 712, 714 that, as discussed above, are each semi-circular in cross section (when a cross section is taken orthogonal to the longitudinal axis of the members 712, 714) and the two members 712, 714 are nested with overlapping portions along each of their edges/sides along the blade 710 to form a hollow cylinder with a length, $L_{Blade}$ (such as in the range of 24 to 60 inches with 30 inches used in one prototype).

The outer ends of the blade body members 712, 714 are attached to an end cap 730, which is semi-spherical in shape and has a circular opening such that the blade members are curved into their semi-circular shape at these attached ends (and the semi-circular shape is further formed/urged by a blade form in the housing/body 740 (as discussed above with reference to blade form 220 in FIGS. 2-5)). The other ends of the blade body members 712, 714 are attached to spools/reels in the housing/body 740 (as discussed with reference to FIGS. 2-5). The blade 710 is configured to have a single width along its length such as one in the range of 0.5 to 2 inches (with 0.7 inches used in one prototype), which matches the OD of the end cap 730 (as measured at is open end that mates with the ends of the blade body members 712, 714). In practice, there is a mathematical relationship between blade length and hilt outer diameter.

The special effects device 700 further includes a flexible light source strip 720 that may take the form of the strip 620 of FIG. 6, and the strip 720 is positioned in the interior space of the cylinder formed by the nesting of blade body members 712, 714. The light source strip 720 is affixed at an outer end to the blade end cap 730 such as to an interior surface of the cap 730 at a center location. As shown in FIG. 7, the light source strip 720 moves outward from the housing/body 740 with the cap 730, which is pushed outward from and away from the housing/body 740 by extension of the two blade body members 712, 714 (e.g., with a drive motor rotating a pair of pulleys used to store the blade body members 712, 714 when the blade 710 is retracted into the body/housing 740). The light sources on the strip 720 are not shown to be lit/powered on in FIG. 7, but typical operations would call for the lights on the strip to be powered on during the extension (and to remain on) to provide internal illumination of the blade body members 712, 714 (which may be formed of diffusion material as discussed above to provide anisotropic diffusion of the light from the light source strip 720). The sensors in the device 700 can drive lighting effects such as flashes when the sensors detect an impact between the blade and another object (such as another blade).

Figure 8B:
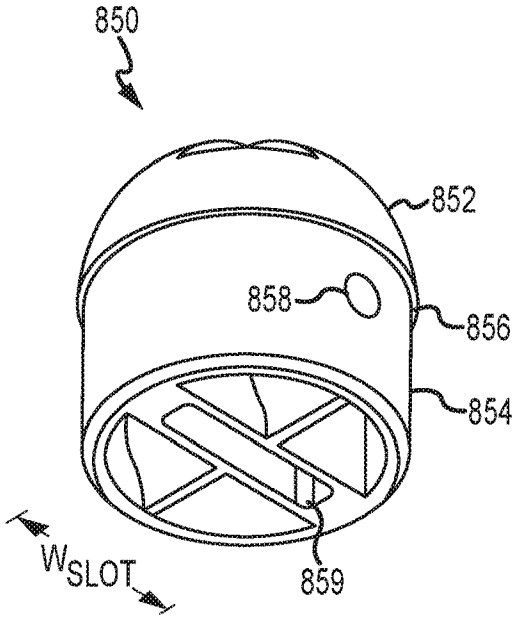
FIGS. 8A and 8B illustrate side and bottom perspective views, respectively, of a blade end cap.
Figure 8A:
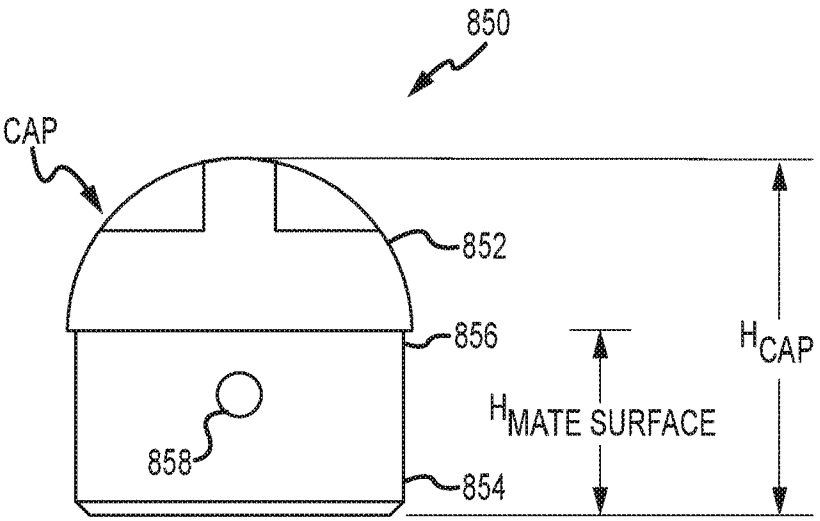

FIGS. 8A and 8B illustrate a blade end cap 850 that may be used within a special effects device of the present description such as those shown in FIGS. 1, 2-5, and 7. As shown, the end cap 850 has an outer tip/end 852 that is semi-spherical in shape (e.g., a hemisphere) with a radius, $R_{Cap}$, that typically will suit the OD of the desired blade such as 0.35 inches when the OD of the blade is 0.7 inches. The end cap 850 may be a solid plastic cap or may be formed of a clear-to-translucent material such as a transparent plastic, glass, or ceramic.

The end cap 850 is configured for mating with and supporting with a particular shape the ends of a pair of blade body members and a flexible strip of light sources (e.g., for use as end cap 730 in the device 700 of FIG. 7). To this end, the end cap 850 includes a cylindrical shaft/body 854 extending outward from the base of the end/tip 852, and the outer surfaces of the cylindrical shaft/body 854 defines a mating surface for receiving the ends of two blade body members and retaining these ends in a circular sectional shape (with overlapping edges to form an enclosed cylindrical blade).

The OD of the shaft/body 854 is less than the OD (or twice the radius, $R_{Cap}$) of the tip/end 852 so as to form a lip/stop 856 at the end abutting an upper edge of the received blade body members. In some embodiments, the surface of the shaft/body 854 is offset from the base of the tip/end 852 by the thickness of the received blade body member (or twice this to allow for overlapping edges or nesting of the blade body members). A hole 858 is provided to receive a rivet/pin for attaching an end of the blade body member to the shaft/body 854 of the cap 850. A slot 859 is provided at the base of the shaft/body 854 of the cap 850 for receiving and mating with an end of a flexible light source strip, and this slot 859 may have a width, $W_{Slot}$, that matches or is some small amount larger than a width of the flexible light source strip (e.g., of the substrate/tape 624 of flexible light source strip 620 of FIG. 6) such as in the range of 0.3 to 0.75 inches or the like). The end of the light source strip may include a hole (such as hole 625 shown in FIG. 6) for allowing the light source strip to be pinned/affixed to the cap 850 once its end is inserted into the slot 859.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

The lightsaber props or special effects devices of the present description provide a solution to the design challenges associated with an extendable and retractable energy sword that is more aesthetically correct than prior devices (such as those with a single bulb in the hilt or swords that extend and retract cutting nested conical shapes). By using anisotropic diffuser films to form the two blade body members, the LED strip (or other flexible strip of light sources) is operable to form an even continuous illumination along the extended blade, which can be rolled or reeled-in to retract it into the hilt.

The design taught herein also produces a blade of continuous (or a single) width along its length (i.e., a width at the base that matches a width at or near the tip of the blade). In contrast, other device designs telescope the blade, which creates a stair-stepped, conical appearance for the blade that is typically undesirable as it does not match the lightsabers shown in films, and it can be problematic in other regards. Particularly, the concentric stages may be loose fitting and not transversely rigid. Also, when a telescoping blade is only slightly bent, it may jam and not fully retract. Overall and in brief, the special effects device or lightsaber prop described provides much more desirable lighting and extension/retraction effects than prior devices and uses a lighting solution that is in line with safety and operating procedures for many theatrical and entertainment settings.

We claim:

1. An apparatus for producing an energy sword special effect, comprising:

a hilt body;

a drive assembly mounted to the hilt body;

a blade member storage within the hilt body; and a blade including a flexible strip with a plurality of light sources, wherein the drive assembly operates in a first operating state to mechanically extend the blade outward from the blade member storage via an opening in the hilt body and in a second operating state to mechanically retract the blade into the blade member storage in the hilt body through the opening in the hilt body, wherein the plurality of light sources is powered on during the first operating state to output light from the blade, and wherein the blade comprises an end cap and a pair of blade body members each attached at a first end to the end cap and having a semicircular cross section in a plane orthogonal to a longitudinal axis of the blade body member.

2. The apparatus of claim 1, wherein the pair of blade body members are at least partially nested to define a hollow cylindrical body of the blade.

3. The apparatus of claim 2, wherein the flexible strip with the plurality of light sources is attached at an end to the end cap and is positioned within the hollow cylindrical body of the blade.

4. The apparatus of claim 1, wherein each of the blade body members comprises a strip of diffusion material providing anisotropic diffusion of the light output from the plurality of light sources.

5. The apparatus of claim 1, wherein each of the blade body members has a planar cross section in a plane orthogonal to a longitudinal axis of the blade body member when the blade body member is retracted into the hilt body and wherein the hilt assembly includes a blade form shaping the blade body members into the planar cross section during retraction of the blade into the hilt body and into the semicircular cross section during extension of the blade from the hilt body.

6. The apparatus of claim 1, wherein the hilt assembly includes a first spool, pivotally supported in the hilt body, for receiving a first one of the blade body members during retraction of the blade into the hilt body and a second spool, pivotally supported in the hilt body, for receiving a second one of the blade body members during retraction of the blade into the hilt body and wherein the drive assembly comprises a drive motor operating to concurrently rotate the first and second spools in a first direction during retraction of the blade into the hilt body and in a second direction, opposite the first direction, during extension of the blade out of the hilt body.

7. The apparatus of claim 6, wherein the hilt assembly further includes a third spool, pivotally supported in the hilt body, for receiving the flexible strip with the light sources during retraction of the blade into the hilt body.

8. The apparatus of claim 1, wherein the blade has a uniform outer diameter along its length when extended out from the hilt body and wherein the blade width is in the range of 0.5 to 2 inches, wherein the blade is moved between a fully retracted state and a fully extended state in less than 1 second, and wherein the blade has a length of at least 24 inches.

9. A special effects device, comprising:

a hilt body;

a drive assembly;

an end cap;

a pair of blade body members each attached to the end cap; and a plurality of light sources, wherein the drive assembly operates in a first operating state to provide motorized extension of the blade body members outward from an opening in the hilt body and in a second operating state to provide motorized retraction of the blade body members into the hilt body through the opening in the hilt body, wherein the plurality of light sources is positioned between the pair of blade body members and are powered to output light when the drive assembly is operated in the first operating state, wherein each of the blade body members has a planar cross section in a plane orthogonal to a longitudinal axis of the blade body member when the blade body member is retracted into the hilt body, and wherein the hilt assembly includes a blade shaping assembly shaping the blade body members into the planar cross section during retraction of the blade into the hilt body and into a semicircular cross section during extension from the hilt body.

10. The special effects device of claim 9, wherein the pair of blade body members are at least partially overlapping when extended from the hilt body to define a hollow cylindrical blade.

11. The special effects device of claim 9, wherein each of the blade body members comprises a strip of diffusion material, whereby the blade body members function as an anisotropic diffuser for light output from the light sources when the blade body members are extended from the hilt body and the light sources are operated to output light.

12. The special effects device of claim 9, further including a first spool, pivotally supported in the hilt body, for receiving a first one of the blade body members during retraction of the blade into the hilt body and a second spool, pivotally supported in the hilt body, for receiving a second one of the blade body members during retraction of the blade into the hilt body, wherein the drive assembly comprises a drive motor operating to concurrently rotate the first and second spools in a first direction during retraction of the blade into the hilt body and in a second direction, opposite the first direction, during extension of the blade out of the hilt body.

13. The special effects device of claim 12, further including a third spool, pivotally supported in the hilt body, for receiving the flexible strip with the light sources during retraction of the blade into the hilt body.

14. An apparatus for producing an energy sword special effect, comprising:

a hilt assembly including a drive assembly within a hilt body; and a blade comprising a pair of blade body members each having, when the blade is extended out from the hilt body, a semicircular cross section in a plane orthogonal to a longitudinal axis of the blade body member, wherein the drive assembly operates in a first operating state to extend the blade outward from an opening in the hilt body and in a second operating state to retract the blade into the hilt body through the opening in the hilt body, and wherein the pair of blade body members are at least partially nested when the drive assembly is operated in the first operating state to define a hollow cylindrical body of the blade.

15. The apparatus of claim 14, wherein the hilt assembly includes a first spool, pivotally supported in the hilt body, for receiving a first one of the blade body members during retraction of the blade into the hilt body and a second spool, pivotally supported in the hilt body, for receiving a second one of the blade body members during retraction of the blade into the hilt body and wherein the drive assembly comprises a drive motor operating to concurrently rotate the first and second spools in a first direction during retraction of the blade into the hilt body and in a second direction, opposite the first direction, during extension of the blade out of the hilt body.

16. The apparatus of claim 14, wherein the blade further includes a flexible strip with a plurality of light sources, wherein the flexible strip with the plurality of light sources is positioned within the hollow cylindrical body of the blade when the drive assembly is operated in the first operating state.

17. The apparatus of claim 16, wherein the light sources each comprises a light emitting diode (LED) and wherein the blade body members comprise strips of diffusion material, whereby the blade body members act as an anisotropic diffuser for light output from the light sources when powered on when the blade is extended from the hilt body.

18. The apparatus of claim 14, wherein each of the blade body members has a planar cross section in a plane orthogonal to a longitudinal axis of the blade body member when the blade body member is retracted into the hilt body and wherein the hilt assembly includes a blade form shaping the blade body members into the planar cross section during retraction of the blade into the hilt body and into the semicircular cross section during extension of the blade from the hilt body.

19. A special effects device, comprising:

a hilt body;

a drive assembly;

an end cap;

a pair of blade body members each attached to the end cap; and a plurality of light sources, wherein the drive assembly operates in a first operating state to provide motorized extension of the blade body members outward from an opening in the hilt body and in a second operating state to provide motorized retraction of the blade body members into the hilt body through the opening in the hilt body, wherein the plurality of light sources is positioned between the pair of blade body members and are powered to output light when the drive assembly is operated in the first operating state, and wherein the pair of blade body members are at least partially overlapping when extended from the hilt body to define a hollow cylindrical blade.

20. The special effects device of claim 19, wherein each of the blade body members comprises a strip of diffusion material, whereby the blade body members function as an anisotropic diffuser for light output from the light sources when the blade body members are extended from the hilt body and the light sources are operated to output light.

21. The special effects device of claim 19, further including a first spool, pivotally supported in the hilt body, for receiving a first one of the blade body members during retraction of the blade into the hilt body and a second spool, pivotally supported in the hilt body, for receiving a second one of the blade body members during retraction of the blade into the hilt body, wherein the drive assembly comprises a drive motor operating to concurrently rotate the first and second spools in a first direction during retraction of the blade into the hilt body and in a second direction, opposite the first direction, during extension of the blade out of the hilt body.

22. The special effects device of claim 21, further including a third spool, pivotally supported in the hilt body, for receiving the flexible strip with the light sources during retraction of the blade into the hilt body.

23. A special effects device, comprising:

a hilt body;

a drive assembly;

an end cap;

a pair of blade body members each attached to the end cap; and a plurality of light sources, wherein the drive assembly operates in a first operating state to provide motorized extension of the blade body members outward from an opening in the hilt body and in a second operating state to provide motorized retraction of the blade body members into the hilt body through the opening in the hilt body, wherein the plurality of light sources is positioned between the pair of blade body members and are powered to output light when the drive assembly is operated in the first operating state, and wherein the special effects device further includes a first spool, pivotally supported in the hilt body, for receiving a first one of the blade body members during retraction of the blade into the hilt body and a second spool, pivotally supported in the hilt body, for receiving a second one of the blade body members during retraction of the blade into the hilt body, wherein the drive assembly comprises a drive motor operating to concurrently rotate the first and second spools in a first direction during retraction of the blade into the hilt body and in a second direction, opposite the first direction, during extension of the blade out of the hilt body.

24. The special effects device of claim 23, wherein each of the blade body members comprises a strip of diffusion material, whereby the blade body members function as an anisotropic diffuser for light output from the light sources when the blade body members are extended from the hilt body and the light sources are operated to output light.

25. The special effects device of claim 24, further including a third spool, pivotally supported in the hilt body, for receiving the flexible strip with the light sources during retraction of the blade into the hilt body.

* * * * *